United States Patent [19]

Ross

[11] Patent Number: 4,884,740

[45] Date of Patent: Dec. 5, 1989

[54] FIBERBOARD DIVIDER FOR SHIPPING CARTONS

[75] Inventor: Glenn D. Ross, Smyrna, Ga.

[73] Assignee: Sonoco Products Company, Hartsville, S.C.

[21] Appl. No.: 211,595

[22] Filed: Jun. 27, 1988

[51] Int. Cl.[4] ..... B65D 5/48

[52] U.S. Cl. ..... 229/120.26; 229/120.29; 229/915; 229/DIG. 4; 229/DIG. 5; 229/DIG. 11

[58] Field of Search ..... 229/120.23, 120.24, 229/120.26, 120.29, 120.35, 120.37, 120.38, 915, 918, 919, DIG. 11, 920, DIG. 4, DIG. 5; 206/593

[56] References Cited

U.S. PATENT DOCUMENTS

| | | | |
|---|---|---|---|
| 1,288,132 | 12/1918 | Nagle | 229/DIG. 4 |
| 1,572,125 | 2/1926 | Binder | 229/DIG. 4 |
| 1,771,760 | 7/1930 | MacLellan | 229/DIG. 4 |
| 2,173,927 | 9/1939 | Allen | 229/DIG. 4 |
| 2,593,092 | 2/1952 | Bergstein | 229/120.26 |
| 2,673,678 | 3/1954 | Morton | 229/37 |
| 2,696,356 | 12/1954 | Baumann | 229/120.24 |
| 2,794,587 | 6/1957 | Weiss | 229/DIG. 5 |
| 3,162,351 | 12/1964 | Rudofski | 229/37 |
| 3,249,445 | 5/1966 | Hackett | 99/171 |
| 3,276,658 | 10/1966 | Locke | 229/15 |
| 3,397,831 | 8/1968 | Adams | 220/416 |
| 3,412,920 | 11/1968 | Desforges | 229/915 |
| 3,536,246 | 10/1970 | Rosen | 229/16 |
| 3,756,496 | 9/1973 | Oostdik | 229/23 |
| 4,272,008 | 6/1981 | Wozniacki | 229/120.23 |
| 4,335,842 | 6/1982 | Bradford et al. | 229/120.24 |
| 4,361,264 | 11/1982 | Philips | 229/120.23 |
| 4,754,916 | 7/1988 | Knight Jr. | 229/120.23 |

FOREIGN PATENT DOCUMENTS

| | | | |
|---|---|---|---|
| 2816563 | 10/1979 | Fed. Rep. of Germany | 229/DIG. 11 |
| 2491874 | 4/1982 | France | 229/120.26 |
| 965880 | 8/1964 | United Kingdom | 229/DIG. 11 |
| 2081225 | 2/1982 | United Kingdom | 229/915 |

*Primary Examiner*—Gary Elkins

*Attorney, Agent, or Firm*—Bell, Seltzer, Park & Gibson

[57] ABSTRACT

A divider is disclosed for imparting stacking strength to a shipping carton wherein the divider is comprised of a pair of fiberboard panels. The panels are aligned in an overlying contiguous relationship and bonded to each other at outer portions. Unbonded medial portions have at least four cut score lines permitting the panels at the medial portions to be separated to form an open support column of rectangular cross section, with the open supprt column providing vertical stacking strength within the carton.

16 Claims, 2 Drawing Sheets

FIBERBOARD DIVIDER FOR SHIPPING CARTONS

FIELD OF THE INVENTION

This invention relates to a divider for use in shipping cartons, and more particularly to a divider for imparting stacking strength to a paperboard shipping carton.

BACKGROUND OF THE INVENTION

Many products are packaged in plastic containers and some of these plastic containers have pour spouts or other constructional features that cannot withstand any compression load. The paperboard carton that these containers are typically packaged in for shipment or warehousing, usually does not need divider partitions within the carton to separate the containers because the containers are plastic and will not easily break. However, these paperboard cartons, without any divider partitions therein, will not withstand the necessary compression load for stacking of the these cartons in the warehouse. Accordingly, many manufacturers have been going back to the larger size cartons which are necessary to accommodate corrugated partitions therein for overcoming the lack of stacking strength even though these corrugated partitions are not required for separation of the containers against breakage within the carton. The corrugated partitions take up more room and thus require larger cartons, and the resulting carton is more expensive. Corrugated material also tends to create a lot of dust and tend to be susceptible to humidity.

Prior art divider systems are primarily directed to corrugated dividers for protecting one item from another during shipping. One example is U.S. Pat. No. 3,756,496 to Oostdik. Oostdik shows a divider made from a one piece blank of corrugated material having cuts arranged therein to allow folding of the blank into a divider network. The divider network is placed in a carton and an article to be packed is positioned in each compartment. This type of arrangement, as discussed earlier, takes up a substantial amount of room in the carton. Because of the thickness of the corrugations, the dividers also take up a lot of storage space, even when folded flat.

U.S. Pat. No. 4,272,008 to Wozniacki shows a variable divider using corrugated paperboard or heavy kraft paper for protecting melons of various sizes. Wozniacki, like other prior art devices, uses material having substantial thickness as evidenced by the drawings. This is necessary for protecting the contents from breakage or bruising, but when storing plastic containers, the thick divider takes up a substantial amount of room at a substantial cost.

U.S. Pat. No. 4,335,842 to Bradford et al. shows a compartment divider to provide stacking strength using double faced corrugated cardboard. This divider, like the other prior art dividers, will require the use of the larger carton to accommodate the corrugated divider.

Because of the above-noted drawbacks of using the corrugated material, some prior efforts have been directed to using fiberboard, which is generally less expensive than corrugated board. An example of a divider system made of fiberboard is U.S. Pat. No. 4,361,264 to Philips, which shows a divider system comprised of several interlocking parts. The Philips divider is seen to be very complicated and expensive, defeating one of the benefits offered by the fiberboard. The complexity of Philips is due to the inherent lack of stability of fiberboard, in that fiberboard will bend rather than support if it is not provided with some type of stabilizing structure.

Accordingly, it is an object of the present invention to provide a divider for use in providing vertical stacking strength to paperboard shipping cartons, and which avoids the disadvantages of the prior art constructions as noted above.

It is a more particular object of the present invention to provide a simple and inexpensive divider for use in a shipping carton, and which provides substantial compression strength to permit stacking of the cartons while requiring very little space in the carton.

SUMMARY OF THE INVENTION

The above and other objects of the invention have been achieved in the present invention by the provision of a divider adapted for use as an internal partition in a shipping carton, and which comprises a pair of rectangular solid fiberboard panels defining inner and outer faces. Each of the panels has a longitudinal length direction and a transverse width direction. The panels also each have at least two longitudinally separated outer portions and an intermediate medial portion which defines the longitudinal separation between adjacent outer portions. The panels are disposed in an overlying contiguous relationship with the inner faces being opposed to each other and the outer portions and medial portions of the panels being respectively aligned. Each of the outer portions is adhesively secured to the opposing outer portion of the other panel. The panels have at least four cut score lines extending transversely the full width dimension thereof, wherein a first two score lines are on the outer faces of the panels and disposed in the vicinity of the longitudinal center of the intermediate medial portion of each panel. A second two score lines are located on the inner face of one of said panels and adjacent respective ones of the junctures of said outer portions. In operation, the medial portions of said panels may be separated to form a transversely extending support column which is generally rectangular in cross section.

When the other panel is free of any additional cut score lines, the outer portions are disposed at right angles to one another when the medial portions are separated. Alternatively, two additional cut score lines may be provided for the other panel and which are positioned generally adjacent the respective junctures of the medial portion and the outer portions. The additional cut score lines allow the outer portions to be disposed in a common plane extending between opposite corners of the supporting column when the medial portions are separated.

BRIEF DESCRIPTION OF THE DRAWINGS

Some of the features and advantages of the invention having been stated, others will become apparent as the description proceeds, and taken in conjunction with the accompanying drawings, in which.

DETAILED DESCRIPTION OF THE PREFERRED EMBODIMENT

Figure 1:
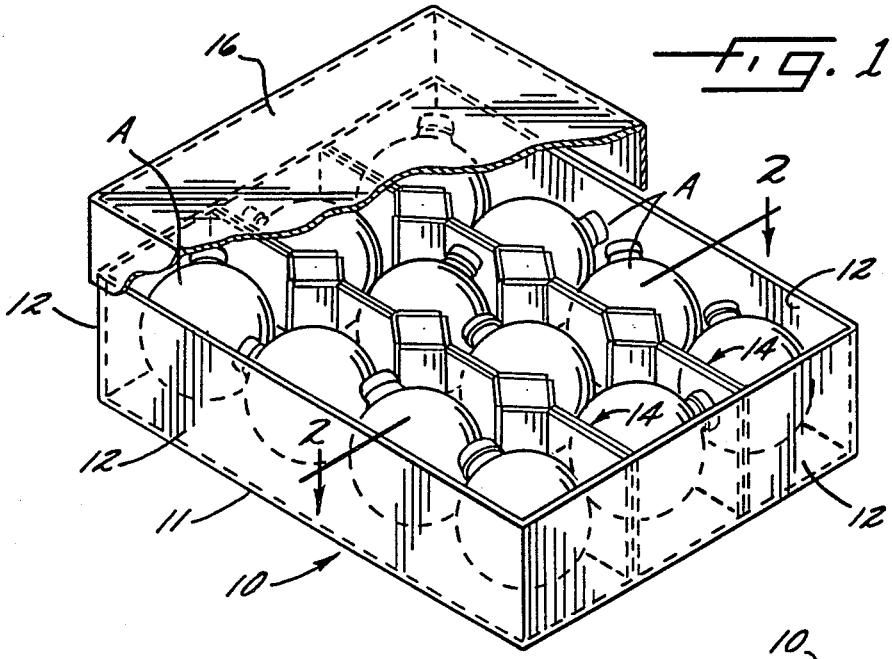
FIG. 1 is a perspective view of a shipping carton and divider which embody the features of the present invention.
Figure 2:
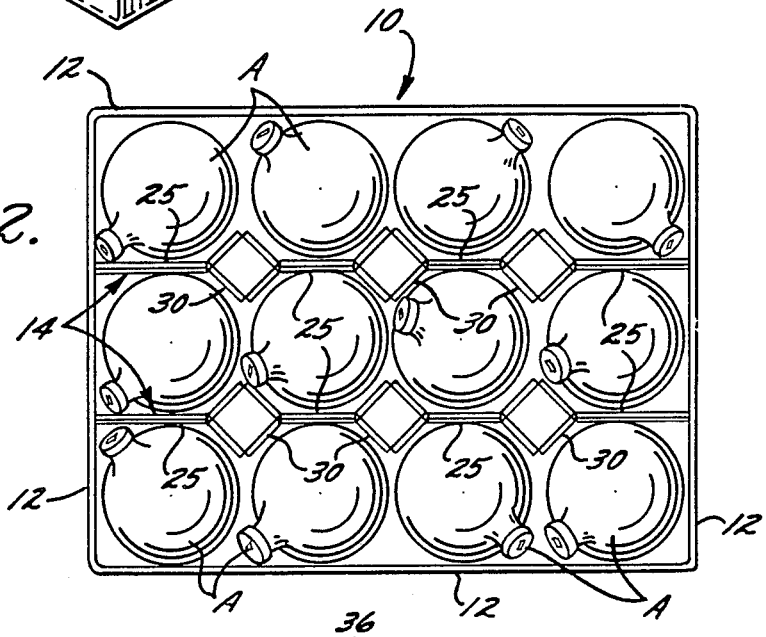
FIG. 2 is a top plan view of the invention taken along line 2—2 in FIG. 1.

Referring now more particularly to the drawings, a conventional carton 10 is illustrated in FIGS. 1 and 2 containing a plurality of articles A. The carton 10 is of conventional relatively lightweight paperboard construction, and it includes a rectangular bottom 11 having four upright side walls 12. Positioned between several of the articles A is a preferred embodiment of the invention designated as divider 14. Two dividers 14 are shown positioned in the carton 10, but it should be understood that the number of dividers used may vary depending on the weight and number of the articles A and the size of the carton 10. A top 16, of conventional design, closes the carton and is supported by the dividers 14 as will be discussed.

Figure 3:
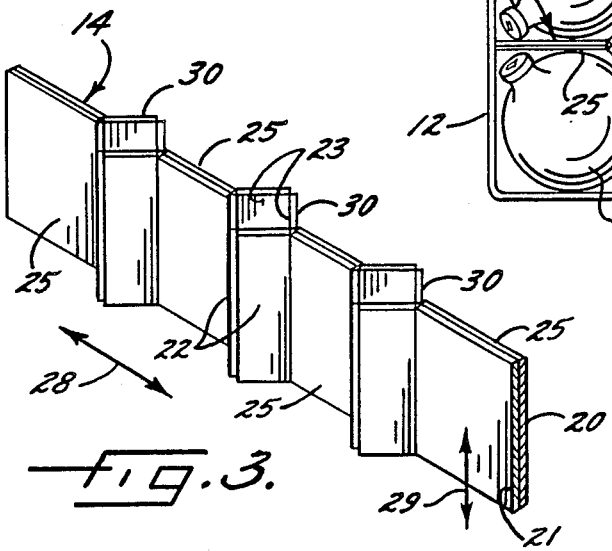
FIG. 3 is a perspective view of the embodiment of the divider shown in FIG. 1.
Figure 4:
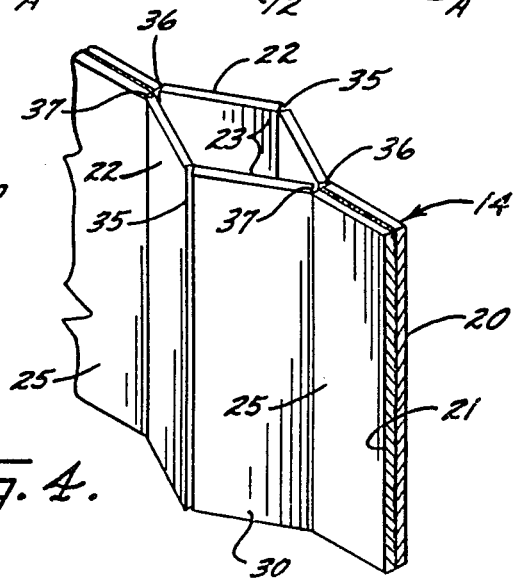
FIG. 4 is an enlarged fragmentary perspective view of the divider.

The construction of the divider 14 is more particularly illustrated in FIGS. 3 and 4. The divider is comprised of a pair of thin rectangular solid fiberboard panels 20 and 21, each having a thickness of between about 0.020 and 0.055 inches. The panels 20 and 21 each have an outer face 22 and an inner face 23. A longitudinal length direction of the panels 20 and 21 is generally indicated by arrow 28 in FIG. 3 and a transverse width direction is generally indicated by an arrow 29. The dividers further have portions along the length thereof designated as outer portions 25 and medial portions 30. The medial portions 30 are disposed between and separate adjacent outer portions 25. The two panels of each divider are disposed in an overlying and contiguous relationship with the inner faces 23 being opposed to each other and the outer portions 25 and the medial portions 30 being respectively aligned. The aligned outer portions 25 are bonded to one another with a suitable adhesive to hold the panels 20 and 21 together as a unitary divider 14.

The dividers are stored flat where they require a minimal amount of space. At the time that the dividers are put into cartons 10, the medial portions 30 are opened up to form small rectangular columns. The medial portions 30, to open up as desired, are provided with a series of parallel cut score lines 35, 36 and 37 extending transversely the full width dimension of the dividers 14. The solid fiberboard panels 20 and 21 also have a predominate grain direction generally oriented in the transverse width direction such that the cut score lines 35, 36 and 37 extend in a direction generally parallel to the grain direction. The cut score lines 35, 36, and 37 are best illustrated in FIG. 4 where medial portion 30 is partially opened and the cut score lines 35, 36, and 37 are shown being parted. The cut score lines 35, 36, and 37 are cut along the width direction, and have a uniform depth of about half the thickness of the panels 20 and 21. A pair of cut score lines 35 are provided on the outer faces 23 of each panel 20 and 21 disposed in the vicinity of the longitudinal center of the intermediate medial portion 30 forming outer corners of the columns. A first panel 20 has a pair of inner cut score lines 36 located adjacent to the junctures of the medial portion 30 and the outer portions 25. The other panel 21 has a pair of cut score lines 37 similar to the cut score lines 36 on the first panel 20. The medial portion, which opens up upon bending the panels at the cut score lines 35, 36 and 37, forms a generally rectangular column as best illustrated in FIG. 2 where the outer portions 25 of the panels 20 and 21 are coplanar and extend along a plane between opposite corners of the column. The cut score lines 35, as illustrated, are aligned with one another so as to form a column having a generally square cross section. Alternatively, the cut score lines 35 may be provided in nonalignment with one another so that the column thus formed has a generally non-square rectangular cross section. It should also be seen in the drawings that the panels 20 and 21 are sized to have a transverse width corresponding to the internal vertical dimension of the carton 10 so that the entire divider 14 can provide internal support for the carton. The thus formed column serves to provide stability to the divider 14 to prevent the divider 14 from bending or lying over in the carton, however, the columns should still be rather small. In particular, the longitudinal length of the medial portion 30 is preferably small compared with the longitudinal length of the outer portions 25.

Figure 5:
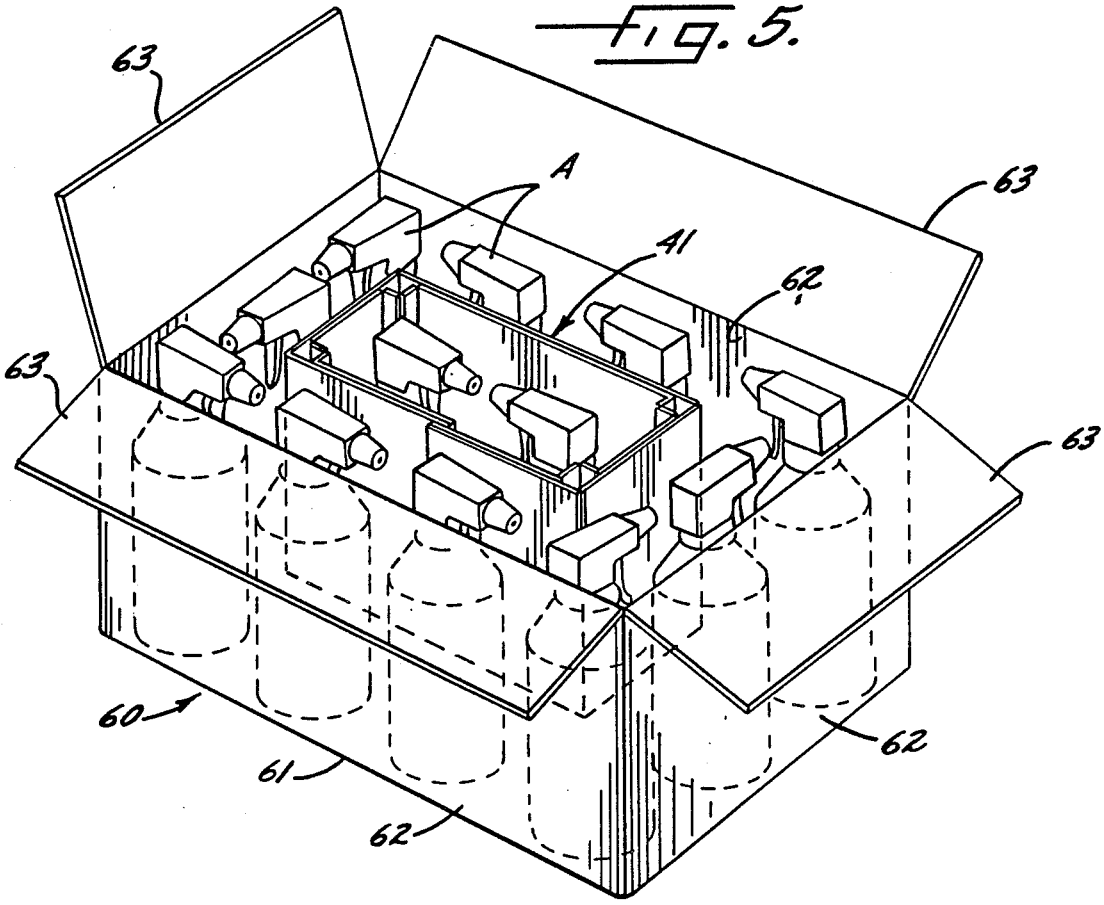
FIG. 5 is a perspective view of a second embodiment of the invention.
Figure 6:
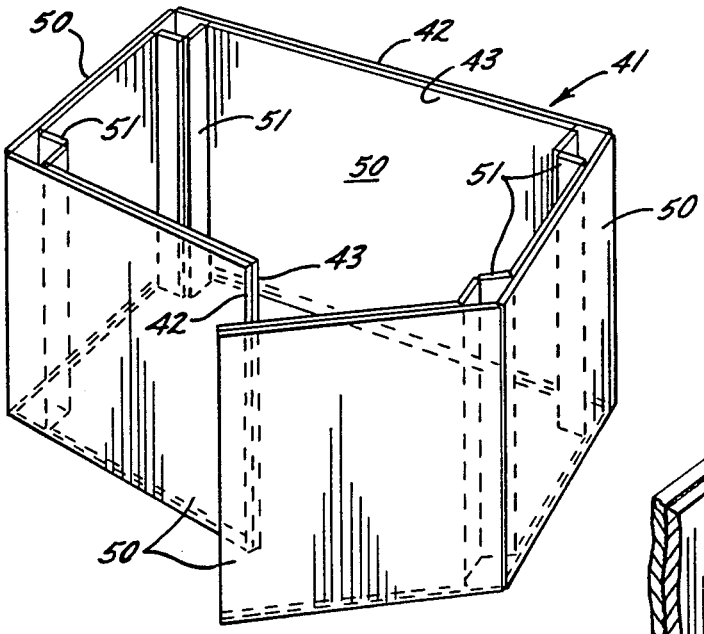
FIG. 6 is a perspective view of the embodiment of the divider shown in FIG. 5.
Figure 7:
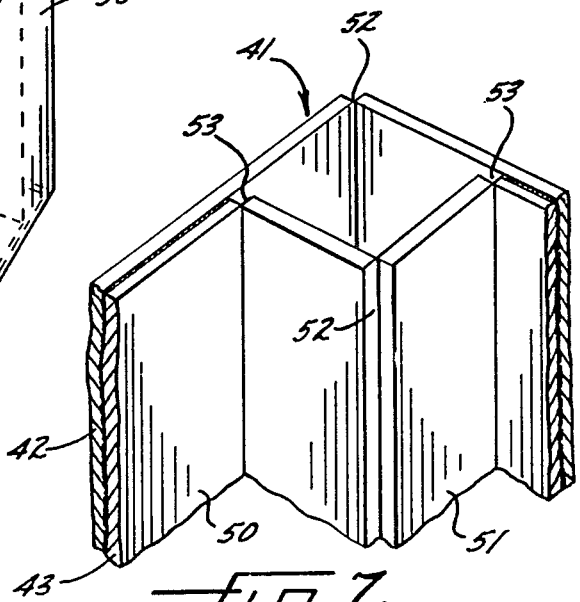
FIG. 7 is an enlarged fragmentary perspective view of the divider of FIGS. 5 and 6.

Illustrated in FIGS. 5–7 is another type of conventional paperboard shipping carton indicated at 60 having a bottom 61, four side walls 62, and four flaps 63 forming a top. Positioned in the carton 60 is a slightly different embodiment of a divider 41, substantially similar to the first embodiment. The divider 41 is comprised of a pair of solid fiberboard panels 42 and 43, similar to fiberboard panels 20 and 21 of the divider 14 which are aligned to form bonded outer portions 50 and unbonded medial portions 51. The panels 42 and 43 have two pairs of cut score lines 52 and 53 at each medial portion 51 so that the medial portions 51 can open up to form small rectangular columns. A pair of cut score lines 52 are provided in a generally central position of the outer face of each medial portion 51 of the divider 41. As illustrated, the pair of cut score lines 52 are aligned so that the columns formed will have a generally square cross section, although it should be understood that the pair of cut score lines 52 may be nonaligned so that the columns formed will have a non-square cross section. The second pair of cut score lines 53 are positioned on the inner face of one of the panels 43 at each juncture between a medial portion 51 and an outer portion 50. It should be noted that the other panel 42 does not have cut score lines at the junctures so that the outer portions 50 are disposed at right angles to one another when the medial portions 51 are opened up to form the column. Also, five outer portions 50 are provided, which permits the divider to be arranged into a closed rectangular configuration as best seen in FIG. 5.

The dividers 14 and 41 have been illustrated with four or five outer portions and three or four medial portions, however, the dividers may alternatively be manufactured in their simplest form which is with one medial portion and two outer portions on respective opposite sides thereof.

As indicated above, the cut score lines preferably extend in the predominant grain direction, which corresponds to the transverse direction of the panels. This facilitates the manufacturing process, since the predominant grain direction is naturally aligned with the longitudinal direction of the sheet from which the panels are formed, and thus the cut score lines may be formed by rotary cutting blades acting on the panel material as it is advanced as a continuous sheet in the longitudinal direction.

The fiberboard divider systems, now having been described, achieve the objects of the invention by providing a simple and inexpensive design, and which may be readily configured to include integral rectangular columns for imparting substantial stacking strength to a carton. The divider is further advantageous over corrugated divider systems of the prior art in several ways. Fiberboard is generally substantially thinner than corrugated paperboard so that it takes up less space when laying flat in storage and when in use in the carton. Since the divider takes up less space, the shipping cartons can be smaller and less expensive than if corrugated dividers were used. Corrugated paperboard is more expensive than fiberboard, making the fiberboard divider system less expensive to manufacture. There is virtually no assembly time related to the manufactured divider system of the present invention thereby reducing labor costs in a packing and shipping department when compared to prior art dividers. Using a fiberboard divider also creates less dust than corrugated paperboard and is less susceptible to humidity.

The foregoing description is to be considered illustrative rather than restrictive of the invention, and those modifications which come within the meaning and range of equivalence of the claims are to be included therein.

That which I claim:

1. A divider adapted for use as an internal partition in a shipping carton or the like and so as to impart substantial vertical stacking strength to the carton, and comprising a pair of rectangular solid fiberboard panels each having inner and outer faces, a longitudinal length direction, and a transverse width direction, with each panel including at least two longitudinally separated outer portions and a medial portion defining the longitudinal separation between each adjacent pair of outer portions;

said panels being disposed in an overlying contiguous relationship with said inner faces being opposed to each other and said outer portions and medial portions of said panels being respectively aligned, and with each of the outer portions of each panel being adhesively secured to the opposing outer portion of the other panel;

said panels having at least six parallel cut score lines positioned at each medial portion and extending transversely the full width dimension of the panel, with a first two of said cut score lines being on the outer face of respective ones of said panels and disposed in the vicinity of the longitudinal center of the intermediate medial portion, a second two of said cut score lines being located on the inner face of one of said panels and adjacent respective ones of the junctures of said medial portion and said outer portions and a third two of said cut score lines being located on the inner face of the other of said panels and adjacent respective ones of the junctures of the associated medial portion and said outer portions of the other panel;

whereby each of the medial portions of said two panels may be separated to form a transversely extending support column which is generally rectangular in cross section and with said outer portions of said panels being generally coplanar and extending along a plane which extends between opposite corners of each thereby formed support column.

2. A divider adapted for use as an internal partition in a shipping carton or the like and so as to impart substantial vertical stacking strength to the carton, and comprising a pair of rectangular solid fiberboard panels each having inner and outer faces, a longitudinal length direction, and a transverse width direction, with each panel including at least two longitudinally separated outer portions and a medial portion defining the longitudinal separation between each adjacent pair of outer portions;

said panels being disposed in an overlying contiguous relationship with said inner faces being opposed to each other and said outer portions and medial portions of said panels being respectively aligned, and with each of the outer portions of each panel being adhesively secured to the opposing outer portion of the other panel;

said panels having at least four parallel cut score lines positioned at each medial portion and extending transversely the full width dimension of the panel, with a first two of said score lines being on the outer face of respective ones of said panels and disposed in the vicinity of the longitudinal center of the intermediate medial portion, and with a second two of said score lines being located on the inner face of one of said panels and adjacent respective ones of the junctures of said medial portion and said outer portions and wherein the other of said panels is free of any additional cut score lines;

whereby the medial portions of said panels may be separated to form a transversely extending support column which is generally rectangular in cross section, and with the outer portions being disposed at right angles to each other.

3. The divider as defined in any one of claims 1 and 2 wherein the medial portions of the pair of panels each extend longitudinally for a distance substantially less than the longitudinal length of said outer portions.

4. The divider as defined in any one of claims 1 and 2 wherein each of said panels has a thickness of between about 0.020 and 0.055 inches.

5. The divider as defined in any one of claims 1 and 2 wherein said fiberboard panels have a predominant grain direction which is oriented in the transverse direction, and such that said cut score lines extend in a direction parallel to said grain direction.

6. The divider as defined in any one of claims 1 and 2 wherein each of said cut score lines extends at least about half way through the thickness of the associated fiberboard panel.

7. The divider as defined in claim 1 wherein said first two score lines are aligned with each other at the longitudinal center of each medial portion of each panel whereby the column formed is generally square in cross section.

8. The divider as defined in claim 1 wherein each panel includes at least three longitudinally separated outer portions with a medial portion disposed between each adjacent pair of outer portions, whereby the medial portions each may be separated to form a transversely extending support column.

9. A shipping carton in combination with a divider adapted to impart substantial vertical stacking strength to the carton, wherein the shipping carton has, in use, a parallel top and bottom, and an internal vertical dimension between said top and bottom, and wherein the divider comprises a pair of rectangular solid fiberboard panels each having inner and outer faces, a transverse width direction generally corresponding to the internal vertical dimension of said shipping carton and a longitudinal length direction, with each panel including at least two longitudinally separated outer portions and a medial portion defining the longitudinal separation between each adjacent pair of outer portions;

said panels being disposed in an overlying contiguous relationship with said inner faces being opposed to each other and said outer portions and medial portions of said panels being respectively aligned, and with each of the outer portions of each panel being adhesively secured to the opposing outer portion of the other panel;

said panels having at least six parallel cut score lines positioned at each medial portion and extending transversely the full width dimension of the panel, with a first two of said cut score lines being on the outer face of respective ones of said panels and disposed in the vicinity of the longitudinal center of the intermediate medial portion, a second two of said cut score lines being located on the inner face of one of said panels and adjacent respective ones of the junctures of said medial portion and said outer portions and a third two of said cut score lines being located on the inner face of the other of said panels and adjacent respective ones of the junctures of the associated medial portion and said outer portions of the other panel;

each of the medial portions of said two panels being separated to form a transversely extending support column which is generally rectangular in cross section with said outer portions of said panels being generally coplanar and extending along a plane which extends between opposite corners of each thusly formed support column, and with the divider being disposed in said shipping carton with each of the support columns extending between said top and bottom to support the weight of other cartons stacked thereon.

10. A shipping carton in combination with a divider adapted to impart substantial vertical stacking strength to the carton, wherein the shipping carton has, in use, a parallel top and bottom, and an internal vertical dimension between said top and bottom, and wherein the divider comprises a pair of rectangular solid fiberboard panels each having inner and outer faces, a transverse width direction generally corresponding to the internal vertical dimension of said shipping carton and a longitudinal length direction, with each panel including at least two longitudinally separated outer portions and a medial portion defining the longitudinal separation between each adjacent pair of outer portions;

said panels being disposed in an overlying contiguous relationship with said inner faces being opposed to each other and said outer portions and medial portions of said panels being respectively aligned, and with each of the outer portions of each panel being adhesively secured to the opposing outer portion of the other panel;

said panels having at least four parallel cut score lines positioned at each medial portion and extending transversely the full width dimension of the panel, with a first two of said score lines being on the outer face of respective ones of said panels and disposed in the vicinity of the longitudinal center of the intermediate medial portion, a second two of said score lines being located on the inner face of one of said panels and adjacent respective ones of the junctures of said medial portion and said outer portions and wherein the other of said panels is free of any additional cut score lines;

each of the medial portions of said two panels being separated to form a transversely extending support column which is generally rectangular in cross section, and with the divider being disposed in said shipping carton with outer portions of the divider being disposed at right angles to each other and the transversely extending the support column extending between said top and bottom to support the weight of other cartons stacked thereon.

11. The combination as defined in any one of claims 9 and 10 wherein the medial portions of the pair of panels each extend longitudinally for a distance substantially less than the longitudinal length of said outer portions.

12. The combination as defined in any one of claims 9 and 10 wherein each of said panels has a thickness of between about 0.020 and 0.055 inches.

13. The combination as defined in any one of claims 9 and 10 wherein said fiberboard panels have a predominant grain direction which is oriented in the transverse direction, and such that said cut score lines extend in a direction parallel to said grain direction.

14. The combination as defined in any one of claims 9 and 10 wherein each of said cut score lines extend at least about half way through the thickness of the associated fiberboard panel.

15. The combination as defined in claim 9 wherein said first two score lines are aligned with each other at the longitudinal center of each medial portion of each panel whereby the column formed is generally square in cross section.

16. The combination as defined in claim 9 wherein each panel includes at least three longitudinally separated outer portions with a medial portion disposed between each adjacent pair of outer portions, whereby the medial portions each may be separated to form a transversely extending support column.

* * * * *